US008103206B2

(12) United States Patent
Gross et al.

(10) Patent No.: US 8,103,206 B2
(45) Date of Patent: Jan. 24, 2012

(54) SYSTEMS AND METHODS FOR CONTROLLING CLEANING DEVICES IN IMAGE FORMING APPARATUS

(75) Inventors: Robert Arnold Gross, Penfield, NY (US); Michael Nicholas Soures, Webster, NY (US); Robert Steven Pozniakas, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 713 days.

(21) Appl. No.: 12/194,743

(22) Filed: Aug. 20, 2008

(65) Prior Publication Data

US 2010/0046997 A1 Feb. 25, 2010

(51) Int. Cl.
*G03G 21/00* (2006.01)

(52) U.S. Cl. ..... 399/346; 399/343; 399/34

(58) Field of Classification Search ..... 399/346
See application file for complete search history.

(56) References Cited

U.S. PATENT DOCUMENTS

| | | | | |
|---|---|---|---|---|
| 4,158,498 | A | 6/1979 | Ohmori | |
| 5,463,455 | A | 10/1995 | Pozniakas et al. | |
| 6,398,345 | B1 * | 6/2002 | Sakai et al. | 347/55 |
| 7,362,996 | B2 | 4/2008 | Facci et al. | |
| 2007/0014605 | A1 * | 1/2007 | Facci et al. | 399/346 |

* cited by examiner

*Primary Examiner* — David Gray
*Assistant Examiner* — Roy Y Yi
(74) *Attorney, Agent, or Firm* — Oliff & Berridge, PLC

(57) ABSTRACT

Systems and methods are provided for controlling cleaning devices in image forming apparatus electrostatic image forming apparatus. Such systems may include a charge receptor, movable in a process direction, defining a main surface. A toner application device applies toner to the charge receptor, and is configured to place a lubrication stripe including the toner on a portion of the main surface of the charge receptor, the position of the lubrication stripe is controlled with respect to a position on the main surface of the charge receptor corresponding to a paper trail edge. The dimensions and density of the lubrication stripe may also be controlled. The lubrication stripe is delivered to a secondary cleaning device including a blade engaging with the photoreceptor surface to lubricate the blade.

18 Claims, 6 Drawing Sheets

SYSTEMS AND METHODS FOR CONTROLLING CLEANING DEVICES IN IMAGE FORMING APPARATUS

The present subject matter relates to systems and methods for controlling cleaning devices in image forming apparatus, and more particularly for cleaning devices, which remove residual toner, additives and debris from a charge retentive surface, that include a secondary cleaning system, such a spots blade, for release and removal of agglomerations that are not removed from the charge retentive surface by a primary cleaning system, such as a brush system.

BACKGROUND

In a typical toner image reproduction machine, for example an electrostatic image forming apparatus, an imaging region of a toner image bearing member, such as a photoconductive member, is charged to a substantially uniform potential so as to sensitize the surface thereof. The charged portion of the photoconductive member is irradiated or exposed to a light image of an original document being reproduced. Exposure of the charged photoconductive member selectively dissipates the charges thereon in the irradiated areas. This records an electrostatic latent image on the photoconductive member corresponding to the informational areas contained within the original document.

After the electrostatic latent image is recorded on the photoconductive member, the latent image is developed by bringing a developer material into contact therewith. Generally, the developer material comprises toner particles adhering to carrier granules. The toner particles are attracted from the carrier granules to the latent image, forming a toner powder image on the photoconductive member. The toner powder image is then transferred from the photoconductive member to a copy sheet. The toner particles are heated to permanently affix the powder image to the copy sheet. Residual toner particles, additives and/or debris remaining on the photoconductive surface following image transfer as above are then removed by a cleaning apparatus in order to prepare the surface for forming another toner image.

Primary cleaning systems were developed to remove residual toner from the photoconductive member prior to the next image development procedure. Such primary cleaning systems may include one or more rotating electrostatic brushes, cleaning blades, electrostatic air cleaners, vacuum systems, and other similar systems used singly or in combination. For example, a rotatable brush is mounted in interference contact to the photoreceptor surface to be cleaned, and the brush is rotated so that the brush fibers continually wipe across the photoreceptor. Electrical bias applied to conductive brush fibers aids in removing and transporting cleaned material away from the photoreceptor surface. In order to reduce the dirt level within the brush, a vacuum system is provided which removes residual toner and toner agents from the brush fibers and exhausts the toner and toner agents from the cleaner.

However, experience has shown that certain agglomerations of toner particles and other materials can stick to photoreceptors or other charge retentive surfaces sufficiently to resist removal by primary cleaning systems.

In response, secondary cleaning systems were implemented in some systems. Such secondary cleaning systems may include a relatively hard cleaning "spots blade" located downstream from the primary cleaning system for the purpose of shearing agglomerations that resist initial cleaning away from the imaging surface. The spots blade may be engaged and disengaged with the imaging surface. For example, U.S. Pat. No. 4,158,498 issued Jun. 19, 1979 and entitled "Blade Cleaning System for a Reproducing Apparatus" discloses a reproducing apparatus that includes a blade cleaning system for removing residual material from an imaging surface. The blade is arranged for movement between a first position wherein an edge thereof engages the imaging surface to remove the residual material, and a second position wherein the edge is spaced from the imaging surface.

Contact cleaning devices, for example, spots blades for cleaning the photoconductive member, may scratch and abrade the surface where there is insufficient lubrication at the interface between the blade and the surface. Thus, it is known to lubricate the image forming surface because lack of sufficient lubrication to the edges of such blades may result in scratching and abrasion of the image forming surface. Lubrication may be provided in the form of residual, or specifically placed, toner substances and/or additives.

U.S. Pat. No. 5,463,455 issued Oct. 31, 1995 and entitled "Method and Apparatus for Adaptive Cleaner Blade Lubrication" discloses an adaptive cleaner blade lubricating system for electrostatic printing machines. The amount of residual toner available to lubricate a cleaner blade is calculated based on the density of the transferred image. A band of toner is deposited in an inter-document gap, or zone ("IDZ"), in selective widths so as to provide an adequate amount of toner to lubricate the cleaner blade across the full width of the photoreceptor. The lubrication band may be variable or may be a constant width with the frequency of placement of the band determined based on average image density for a group of documents.

U.S. Pat. No. 7,362,996 issued Apr. 22, 2008 and entitled "Cleaning and Spots Blade Lubricating Method and Apparatus" discloses a system using a toner patch in the IDZ in combination with switching a cleaner brush bias from a nominal high voltage to near zero voltage to reduce cleaning efficiency.

SUMMARY

Sending a toner patch in the inter-document zone to the spots blade reduces spots blade abrasion. Spots blade abrasion is a function of the mass of toner (Residual Mass "RM"). Without modifying the toner charge, little RM gets by electrostatic cleaning brushes in primary systems such as those discussed above Switching to a low brush voltage, as in U.S. Pat. No. 7,362,996, will reduce brush cleaning efficiency, but may still requires a high Developed Mass ("DM"). For example systems in which brush cleaning efficiency is reduced by less than 50% may require more toner to be applied to the lubrication stripe in order to ensure that sufficient toner reaches the spots blade. This results in high toner costs and requires management of increased toner waste.

It would be desirable to have a cleaning system that would (1) successfully remove a majority of residual toner, additives and debris from a charge retentive surface during normal operation by a primary cleaning device, (2) successfully remove remaining residual elements by a secondary cleaning device, and (3) be adaptable for making the primary cleaning process less efficient under certain circumstances, with, or without, modifying the operation of the primary cleaning device itself. Such an improved cleaning system could, for instance, decrease the cost of ownership of printing systems containing such cleaning systems by extending the service life of a typical photoreceptor or other imaging surface, simplify operation and maintenance of such systems, and/or reduce toner waste, costs and management. Such an improved cleaning system could also compensate for certain system limitations that are not addressed by known methods.

Aspects of the present subject matter may include an electrostatic image forming apparatus, comprising: a charge receptor, movable in a process direction, defining a main surface; a toner application device for applying toner to the charge receptor, and configured to place a lubrication stripe including the toner on a portion of the main surface of the charge receptor at a selected time; a primary cleaning device for cleaning the main surface of the charge receptor, the primary cleaning device including at least one biased member having an effective area associated with the main surface relative to motion of the charge receptor; and a secondary cleaning device configured to engage the main surface of the charge receptor downstream of the biased member, wherein the position of the lubrication stripe is controlled with respect to a position on the main surface of the charge receptor corresponding to a paper trail edge.

Other aspects of the present subject matter may include a method of controlling a cleaning device in an electrostatic image forming device, the method comprising: forming a lubrication stripe on a portion of a photoreceptor surface, during a designated rotation of the photoreceptor surface, upstream of a primary cleaning device comprising a biased member; and delivering the toner stripe to a secondary cleaning device comprising a blade engaging with the photoreceptor surface to lubricate the blade, wherein the position of the lubrication stripe is controlled with respect to a position on the main surface of the charge receptor corresponding to a paper trail edge.

Embodiments may include wherein the position of the lubrication stripe is located in a range of approximately 70-100 msec from the position on the main surface of the charge receptor corresponding to the paper trail edge.

Embodiments may include wherein the position of the lubrication stripe is located in a range of approximately 50-70 msec from the position on the main surface of the charge receptor corresponding to the paper trail edge.

Embodiments may include wherein the position of the lubrication stripe is located in a range of approximately 25-50 msec from the position on the main surface of the charge receptor corresponding to the paper trail edge.

Embodiments may include wherein the position of the lubrication stripe is located in a range of approximately 0-25 msec from the position on the main surface of the charge receptor corresponding to the paper trail edge.

Embodiments may include wherein the position of the lubrication stripe is adjusted with respect to a position on the main surface of the charge receptor corresponding to a paper trail edge based on the presence of toner reproduction curve (TRC) patches on the charge receptor.

Embodiments may include wherein the position of the lubrication stripe is adjusted with respect to a position on the main surface of the charge receptor corresponding to a paper trail edge based on the presence of electrostatic voltmeter (ESV) patches on the charge receptor.

Embodiments may include wherein a process length of the lubrication stripe is adjusted based on the position of the lubrication stripe with respect to the position on the main surface of the charge receptor corresponding to the paper trail edge.

Embodiments may include wherein a cross process width of the lubrication stripe is adjusted based on the position of the lubrication stripe with respect to the position on the main surface of the charge receptor corresponding to the paper trail edge.

Embodiments may include wherein a patch density of the lubrication stripe is adjusted based on the position of the lubrication stripe with respect to the position on the main surface of the charge receptor corresponding to the paper trail edge.

Since most toners used today are negatively charged, the embodiments throughout this disclosure and claims will be described relating to the use of a negative toner, however, when a positive toner is used, the proper opposite adjustments can easily be made.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

These and other objects, advantages and features of the systems and methods according to this disclosure are described and, or apparent from, the following description of exemplary embodiments.

DETAILED DESCRIPTION OF EMBODIMENTS

The following description of various exemplary systems and methods for controlling cleaning devices in image forming apparatus may refer to and/or illustrate a specific type of electrostatic image forming device, a xerographic imaging system, for the sake of clarity, familiarity, and ease of depiction and description. However, it should be appreciated that the principles disclosed herein, as outlined and/or discussed below, can be equally applied to any known, or later-developed, system in which cleaning devices are used to remove residual toner or other marking substances, additives and debris from an image transfer surface.

Generally, the process of electrostatic reproduction is initiated by substantially uniformly charging a photoreceptive member, followed by exposing a light image of an original document thereon. Exposing the charged photoreceptive member to a light image discharges a photoconductive surface layer in areas corresponding to non-image areas in the original document, while maintaining the charge on image areas for creating an electrostatic latent image of the original document on the photoreceptive member. This latent image is subsequently developed into a visible image by a process in which a charged developing material is deposited onto the photoconductive surface layer, such that the developing material is attracted to the charged image areas on the photoreceptive member. A pre-transfer corotron treatment may be used to enhance transfer of developed material. Thereafter, the developing material is transferred from the photoreceptive member to a copy sheet or some other image support substrate to which the image may be permanently affixed for producing a reproduction of the original document. In a final step in the process, the photoconductive surface layer of the photoreceptive member is cleaned to remove any residual developing material therefrom, in preparation for successive imaging cycles.

Figure 1:
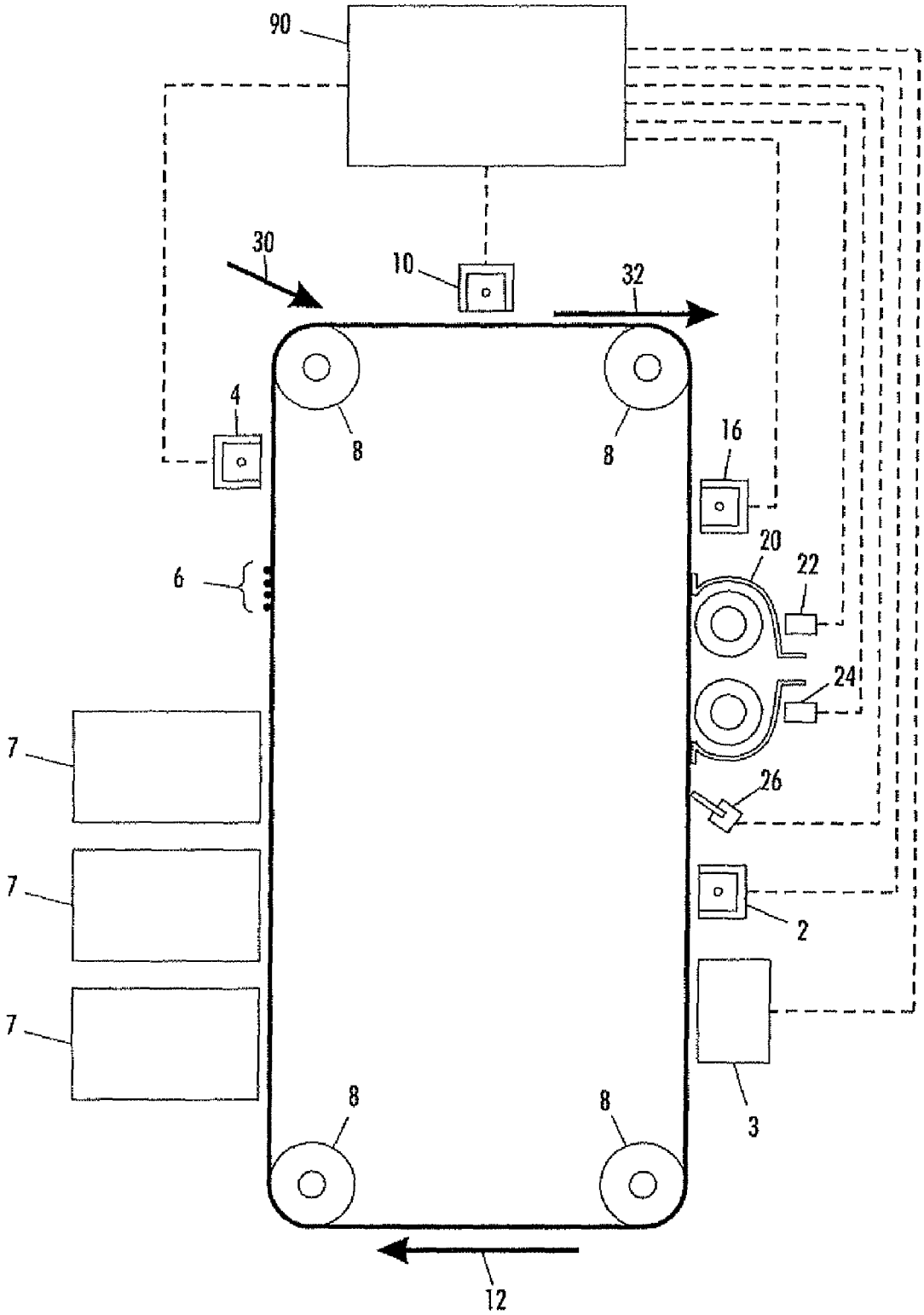
FIG. 1 is a schematic side view of an exemplary electrostatic reproduction machine depicting a cleaning and spots blade lubricating apparatus for the method of the present disclosure.

FIG. 1 illustrates an exemplary photoreceptor unit for developing electrostatic output toner images in an electrostatic image-forming device such as, for example, a xerographic image-forming system. A photoreceptor 1, moving in the direction 12, is electrically charged on its surface by a corotron 2. In this view, photoreceptor 1 is in the form of an endless loop belt around rollers 8, and includes a photoconductive surface. Imaging drums are also common, and the present invention is also applicable to imaging drums. A portion of the photoconductive belt surface passes a charging station where corotron 2 charges the photoconductive surface of photoreceptor 1 to a relatively high, substantially uniform potential.

As also shown, the photoreceptor unit may include a controller or electronic control subsystem (ESS) 90 that is preferably a self-contained, dedicated minicomputer having a central processor unit (CPU), electronic storage, and a display or user interface (UI). The ESS 90, with the help of sensors and connections, can read, capture, prepare and process image data and machine status information. The ESS 90 may be operatively connected to the corotron 2, imaging source 3, pre-transfer corotron 4, de-tack corotron 10, preclean corotron 16, primary cleaning device 20, bias control 22, 24, and secondary cleaning device 26. Although depicted and described as a single unit for purposes of clarity, the ESS 90 may be configured as separate devices, communicating in various ways with the relevant architecture.

Aspects of the present subject matter may include modifying the influence of a pre-transfer corotron 4 to make the toner more positive or less negative, on the photoreceptor 1, in order to reduce a cleaning efficiency of a cleaning device, such as primary cleaning device 20. Exemplary modifications may include altering a power supplied to the corotron, or otherwise modifying an output of the pre-transfer corotron 4 via ESS 90.

By modifying the influence of a specified corotron on the photoreceptor 1, toner particles 6 may be made to adhere more strongly, and thus respond less fully, or less effectively, to the normal function of the primary cleaning device 20. As described herein, aspects of an exemplary primary cleaning device 20 may employ biased brushes that attract negatively charged toner particles. Therefore, by altering the charge of the particles or the photoreceptor 1, specifically in the area in which the lubricating stripe is formed, cleaning efficiency of the primary cleaning device may be reduced with respect to the lubricating stripe, allowing more toner to survive and be delivered to the secondary cleaning device 26.

The above function may be accomplished, for example, by switching the power supply current to the pre-transfer corotron 4 from a nominal set point to an increased positive set point when the portion of the photoreceptor 1 upon which the lubricating stripe will be formed passes the pre-transfer corotron 4.

The charged photoreceptor surface is exposed to light from an imaging source 3, such as an LED bar array, to produce a latent image of an original image on the surface of the moving photoreceptor. The imaging source 3 receives the image signals representing the desired output image and coverts the signals to a modulated output that discharges the photoconductive surface in areas corresponding to non-image areas in the original image, while maintaining the charge on image areas for creating an electrostatic latent image of the original image on the photoreceptor 1. For example, imaging source 3 may employ an LED bar array arranged to illuminate the charged portion of photoconductive belt 10 on a raster-by-raster basis. The imaging source 3 may also be controlled in order to place a lubrication stripe of toner, or other particles, in an IDZ on the photoreceptor 1.

Figure 3:
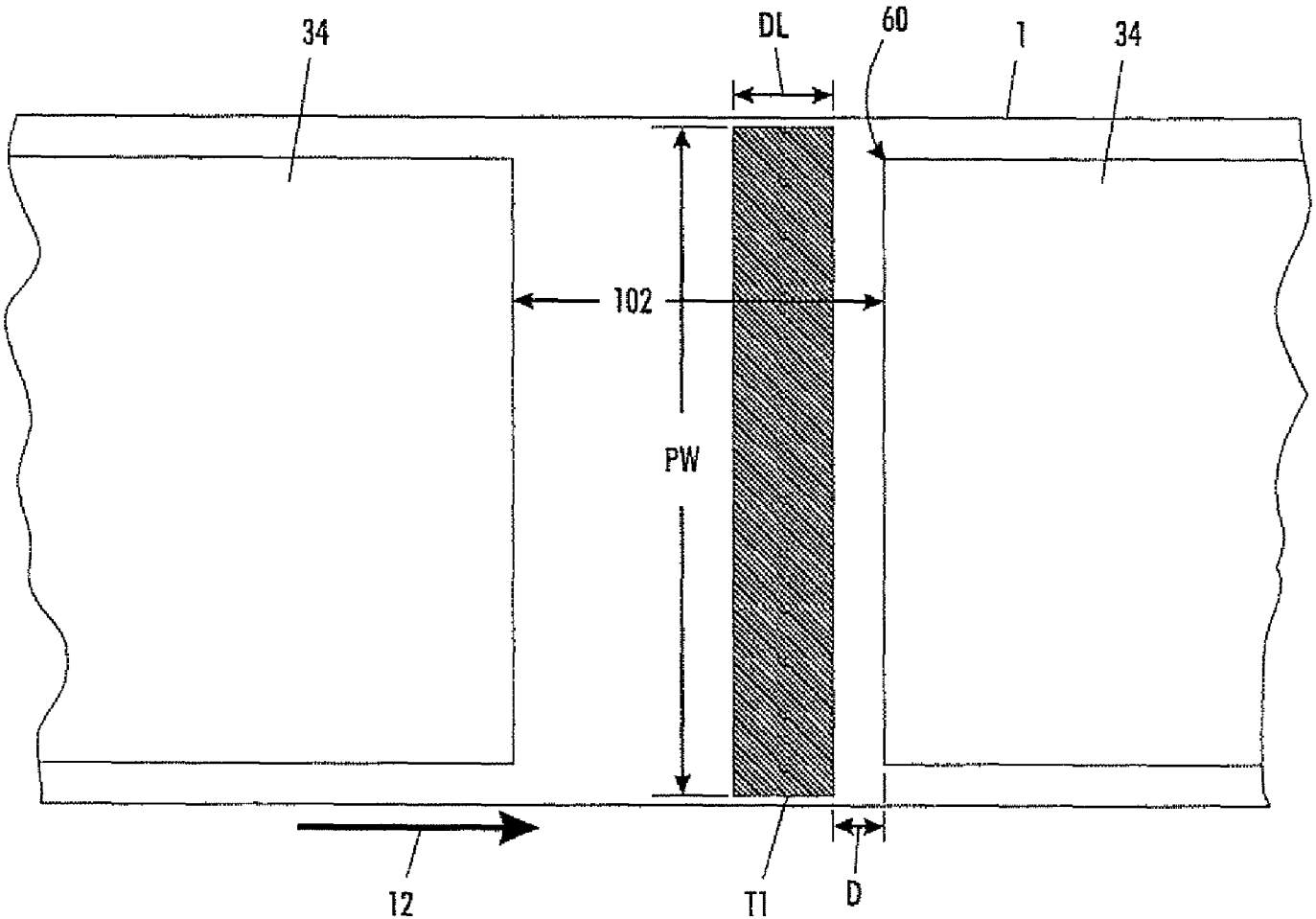
FIG. 3 is a depiction of placement of a lubrication stripe according to the present disclosure.

Aspects of the present disclosure may provide for the placement of the lubrication stripe T1 with respect to a position of a paper trail edge 60, as shown in FIG. 3. A paper trail edge 60 corresponds to a transverse line on the photoreceptor surface separating the trailing edge (with respect to the processing direction 12) of imaging sheet 34 from the IDZ. The lubrication stripe T1 is located a distance D from exemplary paper trail edge 60. As discussed further herein, different placement, and adjustment, of the lubrication stripe T1 with respect to the paper trail edge 60, and other variables such as the presence of TRC and ESV patches, take advantage of the de-tack power supply current regulation characteristic of dropping to a relatively low value when the load on the de-tack corotron changes from paper to no paper.

Aspects of the present subject matter also provide for controlling an area of the lubrication stripe T1 by varying a process length PL, and/or a cross process width PW. Additionally, a patch density of the lubrication stripe may be adjusted to provide for more toner per area unit. These values may be based on an ESV patch used to determine what xerographic settings (e.g., developer and charge) are required to deliver a TRC. The functions of ESV and TRC patches are known to those of skill in the art and are, therefore, not described in detail. In order to achieve the above object, in consideration with other factors, a lube patch % SAC may be changed. For example, there are cases where the image system is unable to deliver the required RM based on current parameters. For instance a 0.01 μgm/cm2 may be optimal for abrasion and toner cost. At a 100% SAC the required patch length may be 0.1 mm, which is difficult to achieve reliably. The present subject matter may achieve the 0.01 μgm/cm2 by using a 20% SAC patch of 2 mm length. Thus, by balancing and adjusting these factors, an appropriate RM may be delivered to lubricate, for example, a spots blade as described further below.

Figure 4:
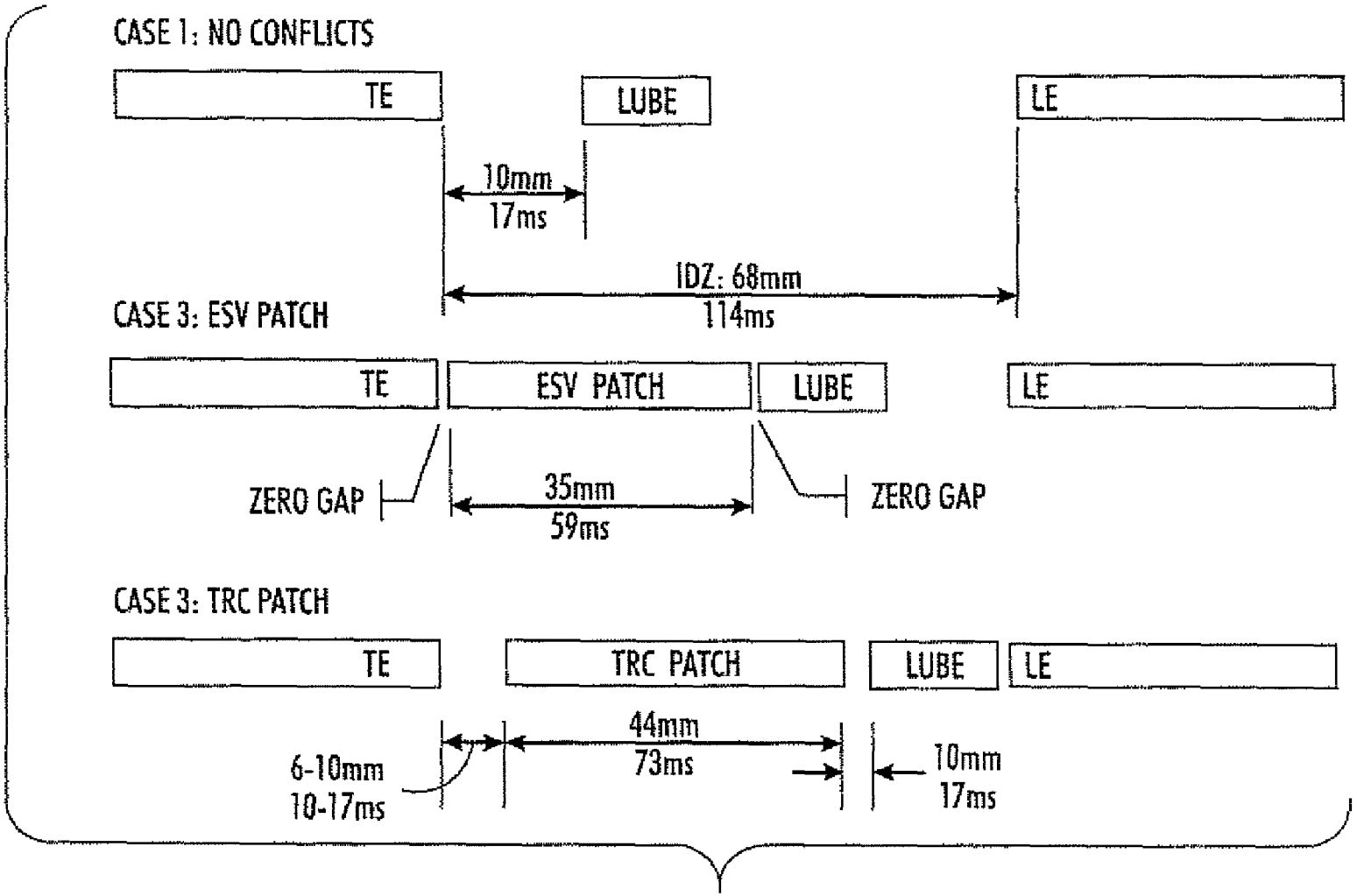
FIG. 4 is a depiction of various placements of a lubrication stripe according to the present disclosure.
Figure 5:
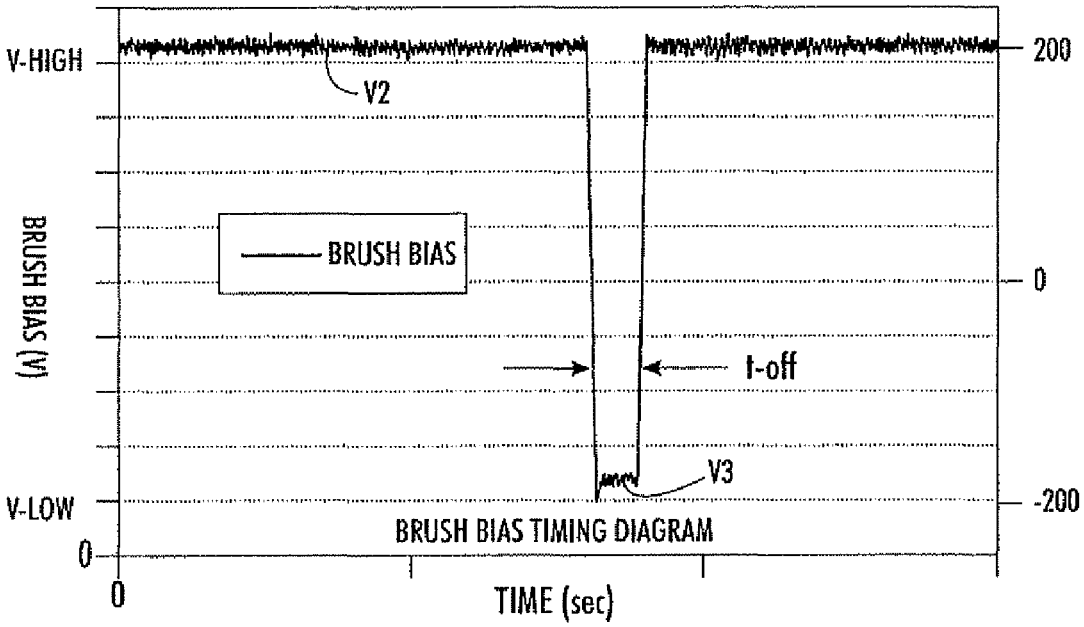
FIG. 5 is a graph of bias modification according to the present disclosure.

In cases in which a TRC patch is present, such as Case 3 in FIG. 4, the lubrication stripe may be located approximately 80 msec from the paper trail edge. When there is an ESV patch, as in Case 2 of FIG. 4, the distance D may be reduced to approximately 60 msec, with little or no gap between the ESV patch and the lubrication stripe. If there is no TRC or ESV patch, as in Case 1 in FIG. 4, the distance D may be reduced to approximately 17 msec. Aspects of the above characteristics are shown in FIG. 4. Aspects of the present subject matter provide for placing the lubrication stripe as close to the paper trail edge as possible, and to receive maximum effect of charge control corotrons and cleaner brushes. Device power supply, and rise and fall times, may determine where reference to the paper trail edge is optimal for lubrication stripe positioning. When a lubrication stripe is placed in an IDZ that has a TRC and/or ESV patch, the lubrication stripe is positioned further downstream. However, based on load changes resulting from a leading edge, it may not be desirable to place the lubrication stripe too close to the leading edge border of the IDZ, as discussed further below.

Because the de-tack power supply is load sensitive, each of the above conditions will provide different levels of de-tack, and result in different cleaning efficiencies with respect to a primary cleaning device, such as those discussed herein.

Advantages of these control methods include minimal, or no, impact on print quality and paper stripping latitude. For example, the detack dynamic current changes as the trail edge of the paper exits the detack region, and the paper lead edge enters the detack region. It may be advantageous to have the paper lead edge see a negative dynamic current to assist in paper stripping. It has been observed that the detack dynamic current responds more positively when the paper trail edge is exiting the corotron region due to the paper load change power supply dynamic current response. Therefore it may be desirable to position the lubrication stripe closer to the paper trail edge. This way the need to change detack lead switching time for reduced cleaning efficiency is not required.

The photoreceptor surface passes toner source(s) 7 wherein toner particles 5, charged opposite of the photoreceptor surface, are attracted to the photoreceptor surface to form an image with toner particles 6 on the photoreceptor surface. The toner particles may be appropriately attracted electrostatically to the latent image at each developer unit using commonly known techniques. Toner source(s) 7 may include multiple developer units as shown, containing CMYK color toners, in the form of dry particles, or a single toner source, such as black toner for grayscale imaging. If the charges on a portion of the photoreceptor 1 have been adjusted, or not adjusted as the case may be, to receive a lubrication stripe, toner may be attracted to this portion of the photoreceptor 1.

With continued reference to FIG. 1, after the electrostatic latent image is developed, the toner powder image present on photoreceptor 1, may receive additional pre-transfer corotron treatment, and then advances to a transfer station from which the toner is transferred from the photoreceptor 1 to, for example, a print sheet. A print sheet is advanced in direction 30 to receive an image from photoreceptor 1 in a timed manner. The transfer station typically includes a corona-generating device, for example de-tack corotron 10, that assists in attracting the toner powder image from photoreceptor 1 to the print sheet.

Similar to the operation discussed with respect to the pre-transfer corotron 4, aspects of the present subject matter may include modifying the influence of the de-tack corotron 10 on the photoreceptor 1, in order to reduce a cleaning efficiency of a cleaning device, such as primary cleaning device 20. Exemplary modifications include changing a power supplied to the de-tack corotron 10, or otherwise changing an output of the de-tack corotron 10 via ESS 90.

By modifying the influence of a de-tack corotron on the photoreceptor 1, toner particles 6 may be made more positive (less negative), and thus respond less fully, or less effectively, to the normal function of the primary cleaning device 20. As described herein, aspects of an exemplary primary cleaning device 20 may employ biased brushes that attract negatively charged toner particles. Therefore, by altering the charge of the toner particles, specifically those in the lubricating stripe, cleaning efficiency of the primary cleaning device may be reduced with respect to the lubricating stripe, allowing more toner to survive and be delivered to the secondary cleaning device 26.

The above function may be accomplished, for example, by switching the power supply current to the de-tack corotron from a high negative set point to a low negative set point when the lubricating stripe passes the de-tack corotron. This may be used in conjunction with modifying a bias of the cleaning brush, such as switching the brush bias from a nominal voltage to a minimum supply voltage. In exemplary embodiments the minimum supply voltage may be about one-half of the nominal voltage used for normal cleaning function. For example, systems are known in which a nominal voltage used for normal cleaning function may be between +400V to +500V, and a minimum supply voltage may be approximately +200V.

The effects of the de-tack corotron may also be adjusted by the placement of the lubrication stripe with respect to the paper trail edge, as discussed above. As depicted in FIG. 4, the de-tack power supply current drops to a relatively low point when the state changes from paper to no paper, i.e. as the paper trail edge passes the corotron. Thus, in a measurable zone immediately after this effect, a de-tack effect is modified, which may allow for toner particles placed within the zone to assume, or maintain, a state that is relatively less favorable for cleaning of the lubrication stripe from the photoreceptor 1 by a cleaning device, such as primary cleaning device 20.

Additionally, depending on the appropriate distance D where the lubrication stripe is placed, and the corresponding de-tack effect, the present disclosure includes tailoring, and/or modifying the characteristics of the lubrication stripe, for example as described above.

After transfer, the print sheet continues to move in the direction of arrow 32 where it is picked up by a pre-fuser transport assembly and forwarded to a fusing station.

After the print sheet is separated from photoreceptor 1, the residual toner/developer particles still on photoreceptor 1 are carried by the photoreceptor 1 to a cleaning station including a pre-clean corotron 16, primary cleaning device 20 and secondary cleaning device 26 in accordance with the present disclosure.

Figure 2:
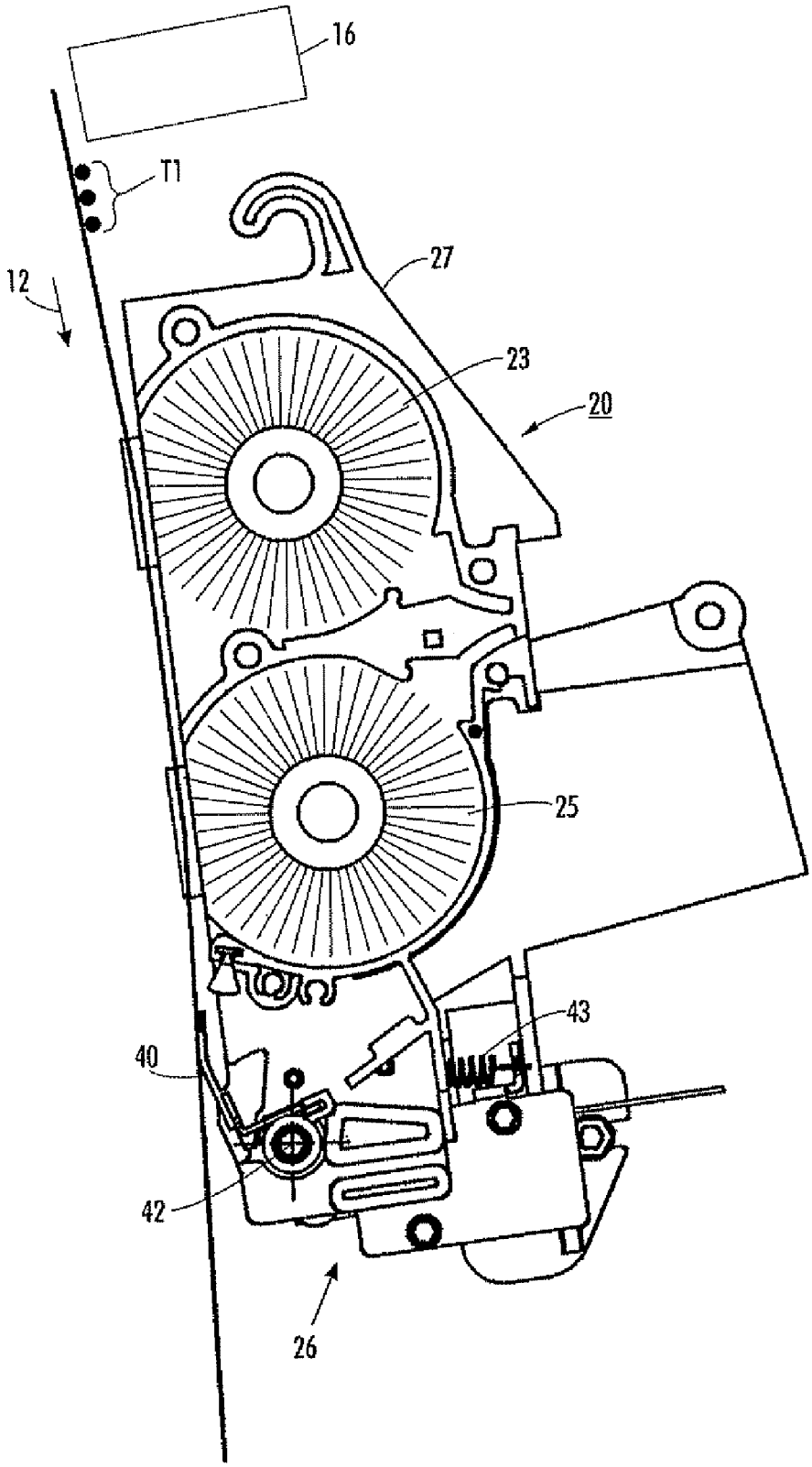
FIG. 2 is a schematic side view of exemplary primary and secondary cleaning devices according to the present disclosure.

Further details of the cleaning station are shown in FIG. 2. Arrow 12 indicates the direction of travel of photoreceptor 1. The segment of photoreceptor 1 shown in FIG. 2 has, before arriving at the cleaning station shown in FIG. 2, been charged, imaged, developed, and had its image transferred to a print sheet.

Aspects of the present subject matter may include modifying the influence of a pre-clean corotron 16 on the photoreceptor 1, in order to reduce a cleaning efficiency of a cleaning device, such as primary cleaning device 20. Exemplary modifications could include modifying a power supplied to the corotron 16, or otherwise modifying an output of the corotron 16 via ESS 90.

By modifying the influence of a pre-clean corotron on the photoreceptor 1, toner particles 6 may be made more positive (less negative), and thus respond less fully, or less effectively, to the normal function of the primary cleaning device 20. By altering the charge of the toner particles, specifically those in the lubrication stripe, by the pre-clean corotron cleaning efficiency of the primary cleaning device may be reduced with respect to the lubrication stripe, allowing more toner to survive and be delivered to the secondary cleaning device 26. Additionally, altering the influence of a pre-clean corotron may be advantageous in minimizing disruption of other system infuctions, such as toner application and de-tack processes.

The above function may be accomplished, for example, by switching a pre-clean power supply voltage from a high negative set point to a low negative set point when the lubrication stripe passes the de-tack corotron. This may be used in conjunction with modifying a bias of the cleaning brush, such as switching the brush bias from a nominal voltage to a minimum supply voltage. In exemplary embodiments the minimum supply voltage may be approximately +200V.

The primary cleaning system 20 shown in FIG. 2 comprises two electrostatic brushes 23, 25, which are charged to attract residual toner particles and debris, are rotated to brush against photoreceptor 1. Housing 27 serves to seal brushes 23, 25 in a chamber in order to further cleaning by pulling a vacuum to remove loosened particles from the bristles of brushes 23, 25. The combination of brushing friction, electrostatic charging of the brushes by bias controllers 22, 24, and vacuum serves to typically remove most of the residual toner and debris left on photoreceptor 1 during the normal operation cycles. As alternatives to brush cleaning systems, other primary cleaning systems can comprise, inter alia, flexible cleaning blades and electrostatic charging/vacuum systems.

Aspects of the present subject matter provide for substantially reversing a bias on the biased member, such as at least one of the cleaning brushes 23, 25 substantially during a time when a lubrication stripe is in the effective area of the biased member, such as the effective area of the cleaning brushes 23, 25. Reversing the bias of an otherwise effective cleaning brush may significantly reduce the cleaning efficiency of the primary cleaning device such that substantial amounts of the toner comprising the lubrication stripe survives on the photoreceptor 1 downstream of the primary cleaning device, thus coming into contact with and lubricating the contact of the photoreceptor 1 with secondary cleaning device 26, such as at spots blade 40.

Other aspects of the present subject matter include modifying a bias of the cleaning brush, such as switching the brush bias from a nominal voltage to a minimum supply voltage. In exemplary embodiments the minimum supply voltage may be approximately +200V whereas a nominal voltage may be in a range of +400V to +500V.

These method may be particularly effective in systems in which it is difficult, or impossible due to design constraints, to reduce the bias of the biasing member in the primary cleaning device below certain levels. In such systems, the biased member may be biased to approximately +200V in a first state, and biased to approximately −200V when the lubrication stripe is in the effective area of the biased member, as depicted in FIG. 3. Alternatively, the bias may be switched from a nominal voltage of approximately +500V to a minimum supply voltage of approximately +200V as depicted in FIG. 4. These values are not exclusive, but illustrate ranges that have been proven effective in the context of the present subject matter, alone and in combination with other aspects described herein.

For example, reversing bias has been found to reduce a cleaning efficiency of the primary cleaning device to levels below 50%, which allows a higher percentage of the applied toner to reach the secondary cleaning device, thus allowing for lubrication stripes of reduced density and/or size. Additionally, combining modifications of the variously described corotrons 2, 10 and 16, and location, dimensions and density of the lubrication stripe T1, in conjunction with switching the brush bias from a nominal voltage to a minimum supply voltage may reduce cleaning efficiency of the primary cleaning device to unexpectedly low levels based on the combined effects of these operations. Using various combinations of the features described above, cleaning efficiency may be reduced by 10% to over 90%.

Secondary cleaning system 26 is shown downstream from primary cleaning system 20 and is comprised, in this embodiment, of spots blade 40, pivot hinge 42, biasing means 43, and a forcing device (not shown), and is operatively connected to ESS 90 (shown in FIG. 1). In FIG. 2, spots blade 40 is in its engaged position and is in contact with and positioned to shear agglomerations from photoreceptor 1.

One aspect of the embodiment shown in FIG. 2 is a configuration that enables blade 40 to be retracted from contact with the surface of photoreceptor 1 even when primary cleaner system 20 is filly engaged in its operative position. Such retraction reduces heat by intermittently allowing the blade to be released from frictional engagement with the photoreceptor and to thereby be cooled. When blade 40 is positioned primarily in the retracted rather than engaged position, frictional heating is minimized. Frictional heat is one contributor to creation and adherence of agglomerations to photoreceptor 1 and to the spot blade. Additionally, maintaining spot cleaning blade 40 primarily in the retracted position greatly reduces the amount of micro-scratching induced by blade 40 to the surface of photoreceptor 1. Wear and scratching are therefore lessened, and the service life of photoreceptor 1 can be extended.

Experience indicates that few agglomerations adhere stubbornly to an imaging surface when first deposited. Adherence increases as the agglomeration is cycled through the imaging process. Since agglomerations often commence as microspots with no or very minor impact upon image quality, it is not necessary for blade 40 to be continually engaged with photoreceptor 1. Although continual engagement is not necessary, sufficient engagement within a sufficient number of imaging cycles is important since agglomerations begin to grow in size and adhere more stubbornly to photoreceptor 1 as imaging cycles are repeated. It is desirable to optimize the time of engagement with the need to clean agglomerations before they adhere too stubbornly. It is found that engagement between about 15 and about 30 percent of the duty cycle period during which photoreceptor 1 is performing imaging is sufficient to remove agglomerations before subsequent removal becomes more difficult. An optimal period of engagement seems to be about 20 percent of the imaging duty cycle period. Another measurement of the period of engagement is that blade 40 should be engaged for less than about 2 of every 6 revolutions of the imaging surface and, preferably, for about one revolution in every 5 revolutions. When an imaging system is being run for diagnostic, machine set-up, maintenance or at other periods in which no ink or toner is being deposited or no copy substrate is being cycled through the machine, blade 40 can safely remain in its retracted position. Such retraction during non-imaging cycles also serves to preserve the imaging surface.

The method of lubricating a spots blade with residual toner particles in accordance with the present disclosure may include forming a lubrication stripe on a portion of photoreceptor 1, during a designated rotation of the photoreceptor surface. This function occurs upstream of the primary cleaning device 20, which comprises a biased member, such as cleaning brush 23. A bias on the biased member may be switched from a nominal voltage to a minimum supply voltage, or substantially reversed, during a time when the lubrication stripe is under the influence of the biased member. The position of the lubrication stripe may be controlled with respect to a position on the main surface of the charge receptor corresponding to a paper trail edge. This combination may allow for increased amounts, or substantially all of, the toner comprising the lubrication stripe to survive on the photoreceptor surface downstream of the primary cleaning device, thus delivering the toner stripe to a secondary cleaning device. The surviving lubrication stripe interacts with a blade of the secondary cleaning device engaging with the photoreceptor surface to lubricate the blade, thereby intermittently enhancing lubrication of the blade and preventing the blade from abrading and scratching the moving photoreceptor surface. It should also be noted that the residual lubrication stripe interacts with residual debris that is not removed from the primary cleaning brush to prevent photoreceptor abrasion caused by the debris. Thus, a "lubrication stripe" as described herein, may be designed to perform more than lubrication between the spots blade and the photoreceptor only.

Figure 6:
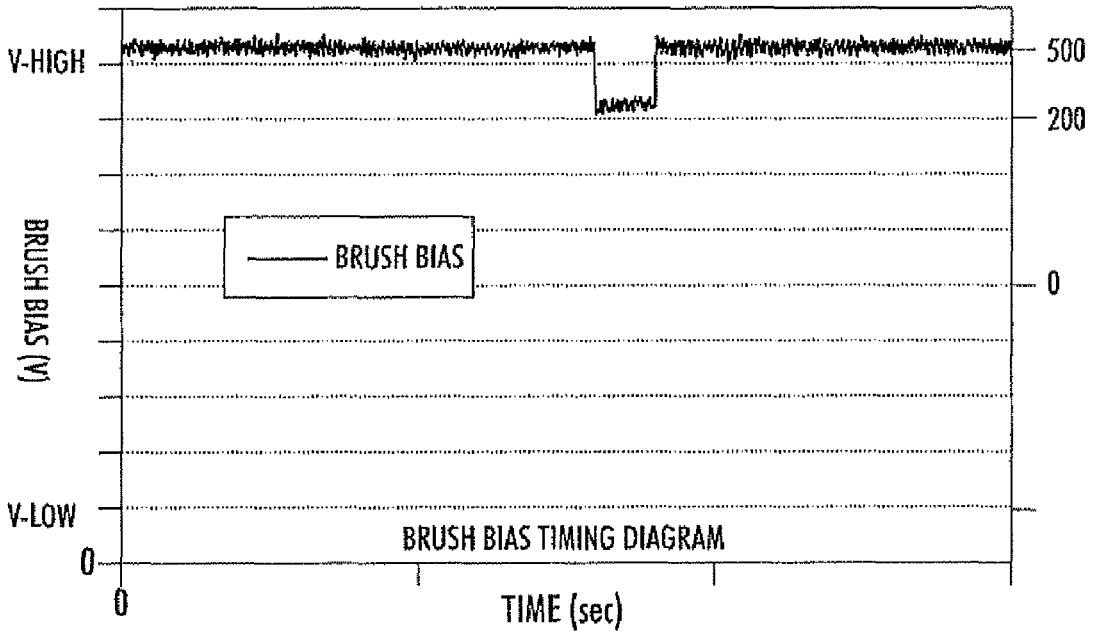
FIG. 6 is a graph of bias modification according to the present disclosure.

It should be noted that, in a dual electrostatic cleaning brush environment, because the bias on the second brush 25 may already be of the same polarity as that of the toner particles of the lubrication stripe T1, only the cleaning bias of the first cleaning brush 23 may need to be modified. When the bias of the first brush 23 is modified, for example from a value of +500V to a value of +200V as illustrated in FIG. 6, increased amounts of negatively charged toner particles of the lubrication stripe T1 on the photoreceptor 1 will move under and past the cleaner brushes 23, as a lubrication stripe to reach the spots blade 40. Delivery of the lubrication stripe to the spots blade 40 acts to lubricate the interface between the spots blade and the photoreceptor, and thus reduces the photoreceptor abrasion significantly.

In accordance with exemplary embodiments, a computer program product may be provided for enabling a computer to control described functions of an electrostatic image forming device. The product may comprise software instructions that enables the computer to perform predetermined operations, and a computer readable medium bearing the software instructions. The predetermined operations may include: forming a lubrication stripe on a portion of a photoreceptor surface, during a designated rotation of the photoreceptor surface, upstream of a primary cleaning device comprising a biased member; and delivering the toner stripe to a secondary cleaning device comprising a blade engaging with the photoreceptor surface to lubricate the blade, wherein the position of the lubrication stripe is controlled with respect to a position on the main surface of the charge receptor corresponding to a paper trail edge. The predetermined operations may also include such other functions as are described herein.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

Aspects of the disclosure may encompass embodiments in hardware, software, or a combination thereof.

The word "printer" as used herein encompasses any apparatus, such as a digital copier, book making machine, facsimile machine, multi-function machine, etc. which performs a printout putting function for any purpose. Although it might occur in printing apparatus has been described in the specification. The claims can encompass embodiments that print in color or handle color image data.

What is claimed is:

1. An electrostatic image forming apparatus, comprising:

a charge receptor, movable in a process direction, defining a main surface;

a toner application device for applying toner to the charge receptor, and configured to place a lubrication stripe including the toner on a portion of the main surface of the charge receptor;

a primary cleaning device for cleaning the main surface of the charge receptor, the primary cleaning device including at least one biased member having an effective area associated with the main surface relative to motion of the charge receptor; and a secondary cleaning device configured to engage the main surface of the charge receptor downstream of the biased member, wherein the position of the lubrication stripe is controlled to fall within only one of three exclusive timing regions with respect to a position on the main surface of the charge receptor corresponding to a paper trail edge, and the only one of the three exclusive timing regions is selected based on the presence or absence of at least one of a toner reproduction curve patch or an electrostatic voltmeter patch on the charge receptor.

2. The apparatus of claim 1, wherein a first of the three exclusive timing regions is in a range of approximately 70-100 msec from the position on the main surface of the charge receptor corresponding to the paper trail edge.

3. The apparatus of claim 1, wherein a second of the three exclusive timing regions is in a range of approximately 50-70 msec from the position on the main surface of the charge receptor corresponding to the paper trail edge.

4. The apparatus of claim 1, wherein a third of the three exclusive timing regions is in a range of approximately 0-25 msec from the position on the main surface of the charge receptor corresponding to the paper trail edge.

5. The apparatus of claim 2, wherein the first of the three exclusive timing regions is selected based on the presence of the toner reproduction curve patch on the charge receptor.

6. The apparatus of claim 3, wherein the second of the three exclusive timing regions is selected based on the presence of the electrostatic voltmeter patch on the charge receptor.

7. The apparatus of claim 1, wherein a process length of the lubrication stripe is adjusted based on the position of the lubrication stripe with respect to the position on the main surface of the charge receptor corresponding to the paper trail edge.

8. The apparatus of claim 1, wherein a cross process width of the lubrication stripe is adjusted based on the position of the lubrication stripe with respect to the position on the main surface of the charge receptor corresponding to the paper trail edge.

9. The apparatus of claim 1, wherein a patch density of the lubrication stripe is adjusted based on the position of the lubrication stripe with respect to the position on the main surface of the charge receptor corresponding to the paper trail edge.

10. A method of controlling a cleaning device in an electrostatic image forming device, the method comprising:

forming a lubrication stripe on a portion of a photoreceptor surface, during a designated rotation of the photoreceptor surface, upstream of a primary cleaning device comprising a biased member; and delivering the toner stripe to a secondary cleaning device comprising a blade engaging with the photoreceptor surface to lubricate the blade, wherein the position of the lubrication stripe is controlled to fall within only one of three exclusive timing regions with respect to a position on the main surface of the charge receptor corresponding to a paper trail edge, and the only one of the three exclusive timing regions is selected based on the presence or absence of at least one of a toner reproduction curve patch or an electrostatic voltmeter patch on the charge receptor.

11. The method of claim 10, wherein a first of the three exclusive timing regions is in a range of approximately 70-90 msec from the position on the main surface of the charge receptor corresponding to the paper trail edge.

12. The method of claim 10, wherein a second of the three exclusive timing regions is in a range of approximately 50-70 msec from the position on the main surface of the charge receptor corresponding to the paper trail edge.

13. The method of claim 10, wherein a third of the three exclusive timing regions is in a range of approximately 0-25msec from the position on the main surface of the charge receptor corresponding to the paper trail edge.

14. The method of claim 11, wherein the first of the three exclusive timing regions is selected based on the presence of the toner reproduction curve patch on the charge receptor.

15. The method of claim 12, wherein the second of the three exclusive timing regions is selected based on the presence of the electrostatic voltage patch on the charge receptor.

16. The method of claim 10, wherein a process length of the lubrication stripe is adjusted based on the position of the lubrication stripe with respect to the position on the main surface of the charge receptor corresponding to the paper trail edge.

17. The method of claim 10, wherein a cross process width of the lubrication stripe is adjusted based on the position of the lubrication stripe with respect to the position on the main surface of the charge receptor corresponding to the paper trail edge.

18. The method of claim 10, wherein a patch density of the lubrication stripe is adjusted based on the position of the lubrication stripe with respect to the position on the main surface of the charge receptor corresponding to the paper trail edge.

* * * * *